United States Patent [19]

Adams et al.

[11] 4,394,052

[45] Jul. 19, 1983

[54] CARPET TAKE-UP DEVICE AND METHOD FOR USING THE SAME

[76] Inventors: Edgar L. Adams, 1516 E. 29th St., Des Moines, Iowa 50317; William D. Ludington, R.R. 1, Carlisle, Iowa 50047

[21] Appl. No.: 283,997

[22] Filed: Jul. 16, 1981

[51] Int. Cl.[3] ..... A47L 11/12; B65H 75/02

[52] U.S. Cl. ..... 299/18; 242/55; 242/86.52; 99/37

[58] Field of Search ..... 242/55, 86.52, 86.5 R, 242/85; 172/19; 156/344, 589; 254/203; 299/18, 37

[56] References Cited

U.S. PATENT DOCUMENTS

| | | | |
|---|---|---|---|
| 737,944 | 9/1903 | Lubin | 411/114 |
| 1,377,169 | 5/1921 | Maize | 242/86.52 |
| 1,865,279 | 6/1932 | Ross | 242/67.1 R |
| 2,005,630 | 6/1935 | Overell | 299/37 |
| 2,164,246 | 6/1939 | Kirkpatrick | 97/226 |
| 2,631,818 | 3/1953 | Whitney | 254/173 |
| 2,655,976 | 10/1953 | Lovin | 159/1 |
| 2,756,661 | 7/1956 | Frisbie | 97/226 |
| 2,778,292 | 1/1957 | Kavan | 97/226 |
| 2,853,273 | 9/1958 | Berge | 254/147 |
| 2,874,946 | 2/1959 | Singleteny | 299/37 |
| 3,053,328 | 9/1962 | Giefel | 172/19 |
| 3,467,331 | 9/1969 | Pepmeier | 242/55 |
| 3,695,713 | 10/1972 | Rofhi | 299/37 |
| 4,084,763 | 4/1978 | Zamboni | 242/86.52 |
| 4,127,280 | 11/1978 | McCullough | 280/5 D |
| 4,332,371 | 6/1982 | Bell | 254/203 |

FOREIGN PATENT DOCUMENTS

| | | | |
|---|---|---|---|
| 576088 | 10/1977 | U.S.S.R. | 172/19 |

*Primary Examiner*—Edward J. McCarthy

*Attorney, Agent, or Firm*—Zarley, McKee, Thomte, Voorhees & Sease

[57] ABSTRACT

A carpet take-up device, for use on carpeting that has been glued down, comprising a spool, a means for rotating the spool, a blade adapted to wedge underneath the carpet and having a knife at each of opposite longitudinal ends, a roller bar, and a rear wheel support. The rotation means rotates the spool so as to roll up the carpet as the blade is pulled forward beneath the carpet.

11 Claims, 12 Drawing Figures

CARPET TAKE-UP DEVICE AND METHOD FOR USING THE SAME

BACKGROUND OF THE INVENTION

Removal of carpet that has been glued to a floor has conventionally been done by hand or by machines that were manually pushed. Such manual labor is hard and exhausting work. It is also difficult to keep the freed carpet rolled up and out of the way of the person working to take up the glued carpet. Conventional carpet removal machines also do not provide any means for neatly cutting a carpet to a width that can be easily handled. Therefore, it is a primary object of the present invention to provide a means that uses a minimum of manual labor for taking up carpet that has been glued to a floor.

A further object is the provision of a carpet take-up device which rolls up the carpet as it is taken up from the floor.

A further object is the provision of a carpet take-up device that cuts the carpet to a convenient width as it is removed from the floor.

A further object is the provision of a carpet take-up device that is durable, easy to use and economical to manufacture.

SUMMARY OF THE INVENTION

The present invention is a carpet take-up device for removing carpet that has been glued down and a method for using the same. The device is adapted to mount onto a conventional carpet removal machine. The carpet take-up device has a spool rotation means that rotates a spool. A blade is wedged beneath the carpet and has a knife at each end to cut the carpet to a convenient handling width. As the spool rotates, the carpet is wound around the spool, thus self-propelling the blade forward beneath the remaining carpet. The present invention therefore accomplishes at least all of its stated objectives.

DETAILED DESCRIPTION OF THE INVENTION

Figure 1:
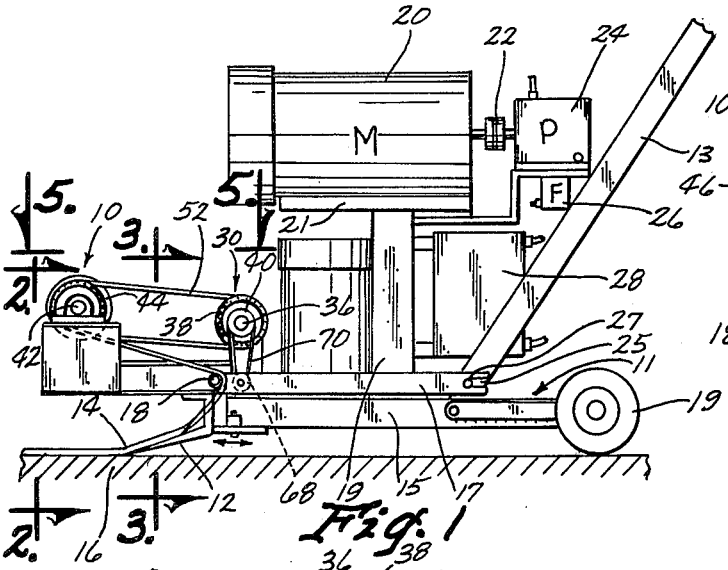
FIG. 1 is a side elevational view of the device.
Figure 2:
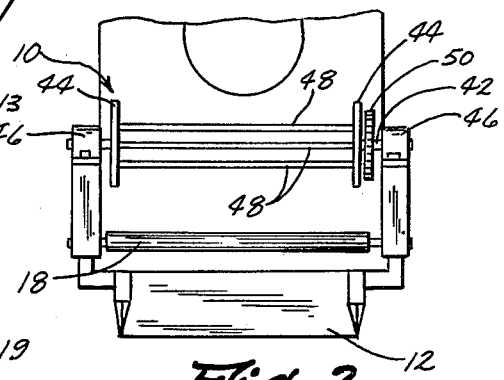
FIG. 2 is a front view of the device taken along line 2—2 of FIG. 1.
Figure 3:
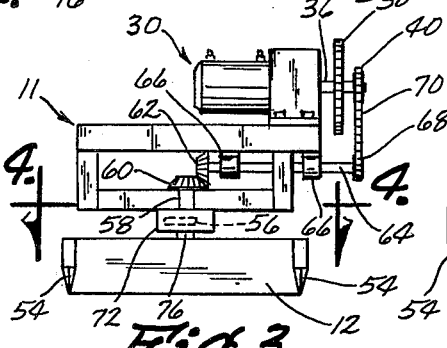
FIG. 3 is a view taken along line 3—3 of FIG. 1.
Figure 4:
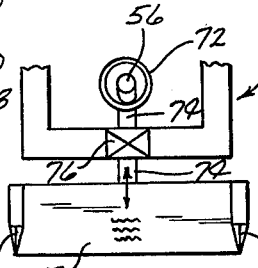
FIG. 4 is a plan view taken along line 4—4 of FIG. 3.

Referring to the drawings, numeral 10 generally designates a carpet spool and numeral 11 indicates the carpet take-up device framework.

The conventional carpet removal machine to which the device is mounted generally consists of a handle 13, a base 15, a blade 12 and a rear wheel 14. The frame work of the carpet take-up device comprises a pair of horizontal rails 17, vertical rails 19 fixed to horizontal rails 17, motor mount 21, and pump and filter support 23 fixed to rails 17. Rails 17 have a slot 25 to receive bolt 27 in handle 13 so that the carpet take-up device can be mounted onto the conventional machine.

Figure 8:
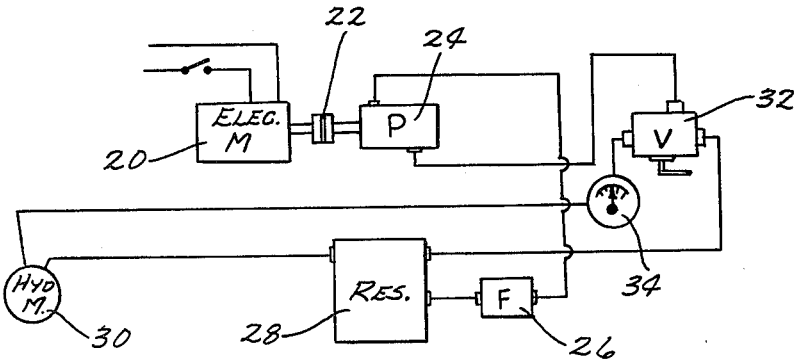
FIG. 8 is a schematic view of the hydraulic circuitry of the device.

The device has a roller bar 18 that keeps tension on the carpet as it is rolled up on a spool 10. The spool 10 is driven by a rotation means that includes an electric motor 20 connected to a hydraulic pump 24 by a jaw couple 22, a hydraulic fluid filter 26, a hydraulic fluid tank 28, a hydraulic motor generally indicated by numeral 30, a valve 32, (FIG. 8) and a pressure gauge 34.

Figure 5:
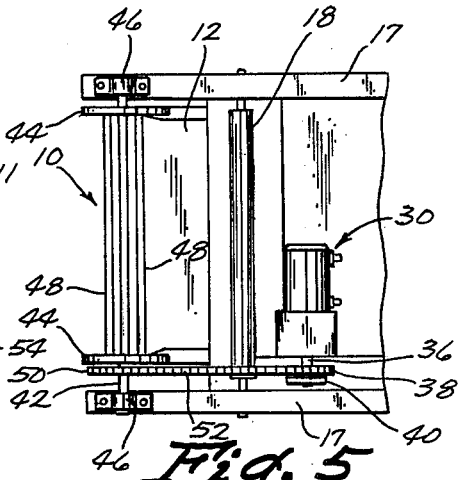
FIG. 5 is a plan view taken along line 5—5 of FIG. 1.
Figure 6:
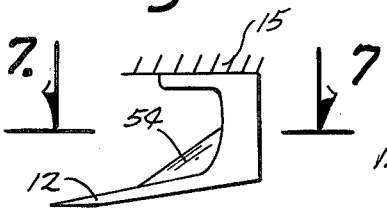
FIG. 6 is a side elevational view of the blade and one of the knives.
Figure 7:
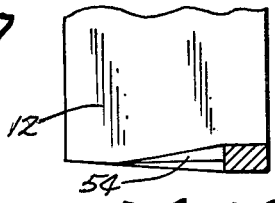
FIG. 7 is a partial plan view of the blade and one of the knives taken along line 7—7 of FIG. 6.

The hydraulic motor has a shaft 36 to which a first sprocket 38 and a second sprocket 40 are connected. The spool has crossbars 48 (FIG. 5) and a sprocket 50 attached to an axle 42 that is journaled within hubs 46 and extends beyond spool carpet guides 44. The first sprocket 38 is drivingly connected to the spool sprocket 50 by a chain 52.

The blade 12 wedges beneath carpet 14 glued to floor 16 and has at each end a knife 54 that cuts the carpet to a convenient width as it is taken up from the floor. A cam 56 is connected to a shaft 58 that has a horizontal star gear 60. In meshing combination with horizontal star gear 60 is a vertical star gear 62 attached to shaft 64 that is journaled within pillow blocks 66. At the opposite end of shaft 64 is a sprocket 68 that is drivingly connected by chain 70 to second sprocket 40 of the hydraulic motor 30. Cam 56 contacts a cam follower 72 that is attached to a bar 74. Acting through pivot bar 76, the cam provides an oscillating movement to the blade and knives as they wedge beneath the carpet.

Figure 9:
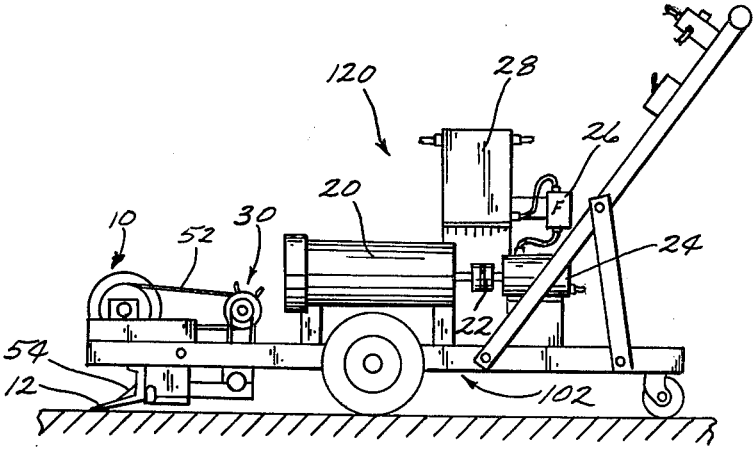
FIG. 9 is a side elevational view of a modified form of the device.

The device in FIG. 9 is a modified form 120 of the carpet take-up device that has its own frame work 102 and does not mount onto a conventional carpet removal machine. The parts of device 120 which correspond to equivalent parts of the device shown in FIG. 1 are indicated by the same corresponding numerals.

Figure 10:
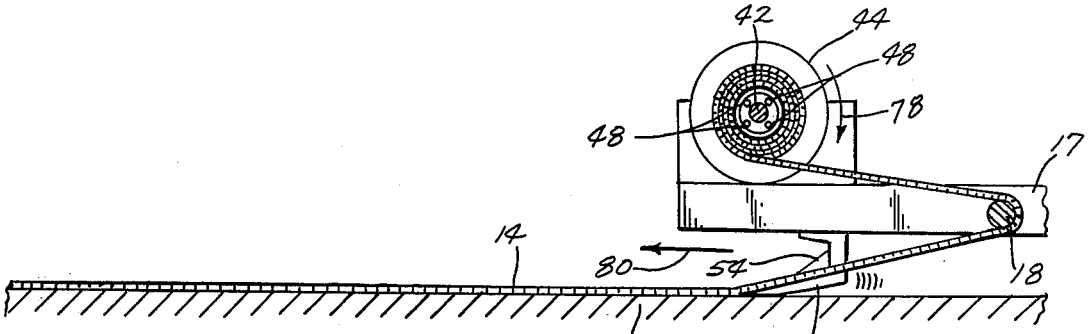
FIG. 10 is a side elevational view showing the use of the device of FIG. 9.

Referring to FIG. 10 blade 12 is wedged beneath a carpet 14. A free end of the carpet is passed around roller bar 18 and attached to spool 10. Actuation of the spool rotation means rotates the spool, thus rolling the carpet as shown by arrow 78 about the spool crossbars 48 and between the guides 44. As the carpet is wound up about the spool, the blade is automatically pulled forward beneath the remaining carpet as indicated by arrow 80.

Figure 11:
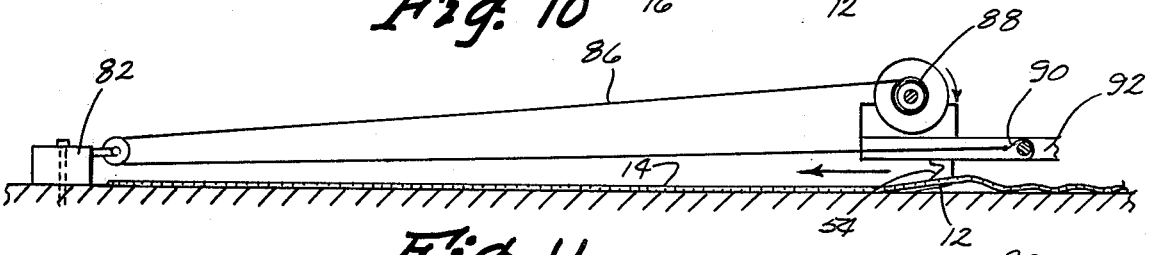
FIG. 11 is a side elevational view showing the use of a first modified form of the device of FIG. 9.

FIG. 11 shows a modified form of the carpet take-up device. In this form, a floor anchor 82 having a pulley 84 is anchored to the floor at the end of the carpet opposite the carpet take-up device. A cable 86 is attached at one end 88 to the spool, passes through the pulley and is attached at the other end 90 to the frame of the device 92. The cable is wound up on the spool as the spool rotates, thus automatically pulling the blade forward beneath the remaining carpet.

Figure 12:
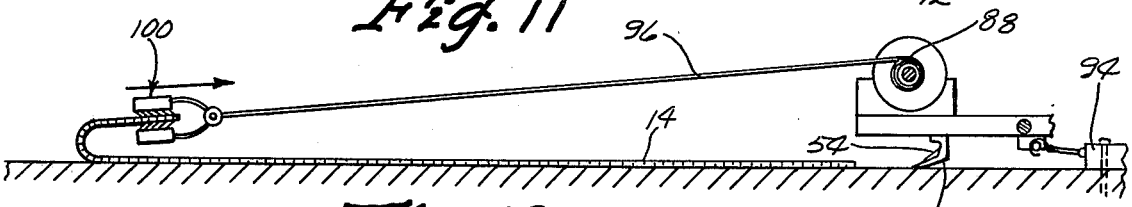
FIG. 12 is a side elevational view showing the use of a second modified form of the device of FIG. 9.

FIG. 12 shows a second modified form of the device. In this form, the device is anchored to the floor at one end of the carpet by a floor anchor 94. A cable 96 is fastened at one end 88, to the spool. The cable has at the opposite end a carpet clamp 100 which is attached to the carpet at the end opposite the carpet take-up device. As the spool rotates, the cable is wrapped around the spool, thus pulling up the carpet.

What is claimed is:

1. A carpet take-up device for removing carpet from a supporting surface, said device comprising:

a frame having forward and rearward ends;

a spool mechanism rotatably mounted on said frame for rotation about a horizontal axis, said spool mechanism being adapted to retentively receive a loose end of said carpet, a means for rotating said spool mechanism, a blade adapted to wedge beneath said carpet, and having opposite longitudinal ends, a rear support wheel, a roller bar rotatably mounted to said frame behind and below said spool mechanism and behind and above said blade, and said loose end of said carpet passing above said blade, behind and around said roller bar and being connected to said spool mechanism such that rotation of said spool mechanism causes said blade to be pulled forward beneath said carpet to free said carpet from said supporting surface.

2. A carpet take-up device according to claim 1 wherein said spool mechanism has at least two longitudinal crossbars.

3. A carpet take-up device according to claim 1 wherein said spool rotation means comprises an electric motor, a hydraulic system including a hydraulic motor, a first coupling means coupling said electric motor with said hydraulic system, and a second coupling means coupling said hydraulic motor with said spool mechanism.

4. A carpet take-up device according to claim 3 wherein said first coupling means comprises interlocking jaws.

5. A carpet take-up device according to claim 3 wherein said second coupling means comprises a first sprocket attached to said hydraulic motor, a second sprocket attached to said spool mechanism, and a chain drivingly connecting said first and second sprockets.

6. A carpet take-up device according to claim 1 wherein said device has a cam and a third coupling means coupling said hydraulic motor to said cam producing a camming action in said blade.

7. A carpet take-up device according to claim 6 wherein said third coupling means comprises a first sprocket attached to said hydraulic motor, a second sprocket, a chain drivingly connecting said first and second sprockets, a vertical star gear integrally connected to said second sprocket by means of a first shaft, a horizontal star gear in meshing combination with said vertical star gear and integrally connected to said cam by means of a second shaft.

8. A carpet take-up device according to claim 1 wherein said blade has a knife at each of said opposite longitudinal ends.

9. A method for using a carpet take-up device comprising a spool mechanism, a spool rotation means, a blade having a knife at each of opposite longitudinal ends, a roller bar positioned behind and above said blade and behind and below said spool, and a rear wheel support, said method comprising: wedging said blade beneath one loose end of a carpet; passing said loose end of said carpet behind and around said rolling bar;

securing said loose end of said carpet to said spool mechanism;

actuating said spool rotation means causing rotation of said spool mechanism, rolling up of said carpet about said spool mechanism, and pulling forward of said blade beneath said carpet.

10. A method for using a carpet take-up device comprising a spool mechanism, a spool rotation means, a blade having a knife at each of opposite longitudinal ends, a rear wheel, a floor anchor having a pulley, and a cable having one end attached to said spool mechanism and an opposite free end, said method comprising:

anchoring said floor anchor at one end of said carpet;

threading said free end of said cable through said pulley and fastening said free end to said carpet take-up device;

wedging said blade beneath a loose end of carpet opposite said floor anchor;

actuating said spool rotation means causing rotation of said spool mechanism, rolling up of said cable about said spool mechanism, and pulling forward of said blade beneath said carpet.

11. A method for using a carpet take-up device comprising a spool mechanism, a spool rotation means, a floor anchor, and a cable having one end attached to said spool mechanism and an opposite end having a carpet clamp device; said method comprising:

anchoring said floor anchor at one end of a carpet;

attaching said carpet take-up device to said floor anchor;

attaching said carpet clamp device to said carpet opposite said floor anchor;

actuating said spool rotation means causing rotation of said spool mechanism, rolling up of said cable about said spool mechanism, and pulling said carpet clamp device and said carpet toward said carpet take-up device.

* * * * *